US007887376B1

(12) United States Patent
Zhang et al.

(10) Patent No.: US 7,887,376 B1
(45) Date of Patent: Feb. 15, 2011

(54) AUDIO JACK CONNECTOR

(75) Inventors: Hong-Tu Zhang, Guang-Dong (CN); Fei Liu, Guang-Dong (CN); Ping-Chih Chen, Tu-Cheng (TW); Ming-Chiang Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/757,212

(22) Filed: Apr. 9, 2010

(51) Int. Cl.
*H01R 24/04* (2006.01)

(52) U.S. Cl. ..... 439/668; 439/108; 439/607.36; 439/939

(58) Field of Classification Search ..... 439/108, 439/668, 669, 939
See application file for complete search history.

(56) References Cited

U.S. PATENT DOCUMENTS 7,387,543 B1 * 6/2008 Wu et al. ..... 439/668
7,717,753 B2 * 5/2010 Chen ..... 439/668

* cited by examiner

*Primary Examiner*—James Harvey
(74) *Attorney, Agent, or Firm*—Cheng-Ju Chiang

(57) ABSTRACT

An audio jack connector includes an insulating housing having a rectangular base, and a plurality of contacts received in the insulating housing. A front end of the base is protruded forwards to form an insertion portion. A passageway is formed at a front of the insertion portion and extends into the base. The front end of the base has a holding slot located adjacent to the insertion portion, and a through slot which passes through an outer side of the holding slot and exposes the insulating housing. A shielding shell has a barrel surrounding the insertion portion, and a grounding element of substantially inverted-L shape connected with the barrel. The grounding element has a connecting slice extending rearwards from a rear edge of the barrel, inserting into the holding slot, and a grounding slice bent perpendicularly from an edge of the connecting slice, passing through the through slot.

9 Claims, 5 Drawing Sheets

AUDIO JACK CONNECTOR

BACKGROUND OF THE INVENTION

1. Field of the Invention

The present invention relates to a connector, and particularly to an audio jack connector having a simple and compact shielding structure.

2. The Related Art

Please refer to FIG. 1, a conventional audio jack connector 100' includes an insulating housing 10', a shielding shell 20', and a plurality of contacts mounted to the insulating housing 10'. The insulating housing 10' has an insertion portion 11' at a front end thereof. A passageway 15' is formed at a front of the insertion portion 11' and extends into the insulating housing 10' for receiving a mating audio plug (not shown). A bottom of the insulating housing 10' has a fixing recess 12', a switch recess 13' and a plurality of connecting recesses 14'. The switch recess 13' has a groove 131' which penetrates into the insertion portion 11' and communicates with the passageway 15'. The contacts includes a fixing contact 30' received in the fixing recess 12', a switch contact 40' received in the switch recess 13', and a plurality of connecting contacts 50' received in the connecting recesses 14'. The fixing contact 30' has a substantially rectangular holding plate 31', a grounding piece 32' bent perpendicularly from a rear end of a bottom edge of the holding plate 31', and an elastic arm 33' extended forwards from a substantially middle of a front edge of the holding plate 31'. The elastic arm 33' is received in the groove 131' and has a free end protruded outwards to form a first contact lump 331'. The first contact lump 331' connects with an inner side of the shielding shell 20' when the shielding shell 20' is coupled with the insertion portion 11'. A lower end of the front edge of the holding plate 31' is extended frontward to form a second contact lump 332' which is connected with an outer side of the shielding shell 20'. The switch contact 40' has a fixing plate 41'. A second soldering piece 42' and an L-shaped contact arm 43' are perpendicularly bent toward the same side of the fixing plate 41' from a rear end and a front end of a bottom edge of the fixing plate 41'. The contact arm 43' has a leg extending forwards. The contact arm 43' is accommodated in the groove 131' for electrically connecting with the inserted audio plug.

The shielding shell 20' is grounded by the first contact lump 331' connecting with the inner side thereof and the second contact lump 332' connecting with the outer side thereof. However, such grounding structure is complicated and uneasy to manufacture and assemble. Furthermore, the engagement between the shielding shell 20' and the fixing contact 30' is unsteady and liable to have a bad influence on the shielding effect.

SUMMARY OF THE INVENTION

Accordingly, an object of the present invention is to provide an audio jack connector having a simple and compact shielding structure. The audio jack connector for receiving a mating audio plug includes an insulating housing having a rectangular base, a plurality of contacts received in the insulating housing and a shielding shell. The base defines a front end and a bottom surface. The front end is protruded forwards to form an insertion portion. A passageway is formed at a front of the insertion portion and extends into the base for receiving the audio plug. The front end has a holding slot located adjacent to the insertion portion, and a through slot which passes through a portion of an outer side of the holding slot and exposes outside the insulating housing. The shielding shell has a barrel surrounding a periphery of the insertion portion, and a grounding element of substantially inverted-L shape connected with the barrel. The grounding element has a connecting slice extending rearwards from a portion of a rear edge of the barrel, for inserting into the holding slot, and a grounding slice bent substantially perpendicularly from an edge of the connecting slice, for extending outside the insulating housing through the through slot.

As described above, the audio jack connector is provided with the shielding shell. The shielding shell has the barrel around the insertion portion and the grounding element of substantially inverted-L shape connected with the barrel and grounded to a printed circuit board to release the generated static electricity. Such structure is simple and convenient to manufacture and assemble. Furthermore, the connection structure between the barrel and the grounding element is firm and steady, which is excellent to guarantee the grounding effect.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
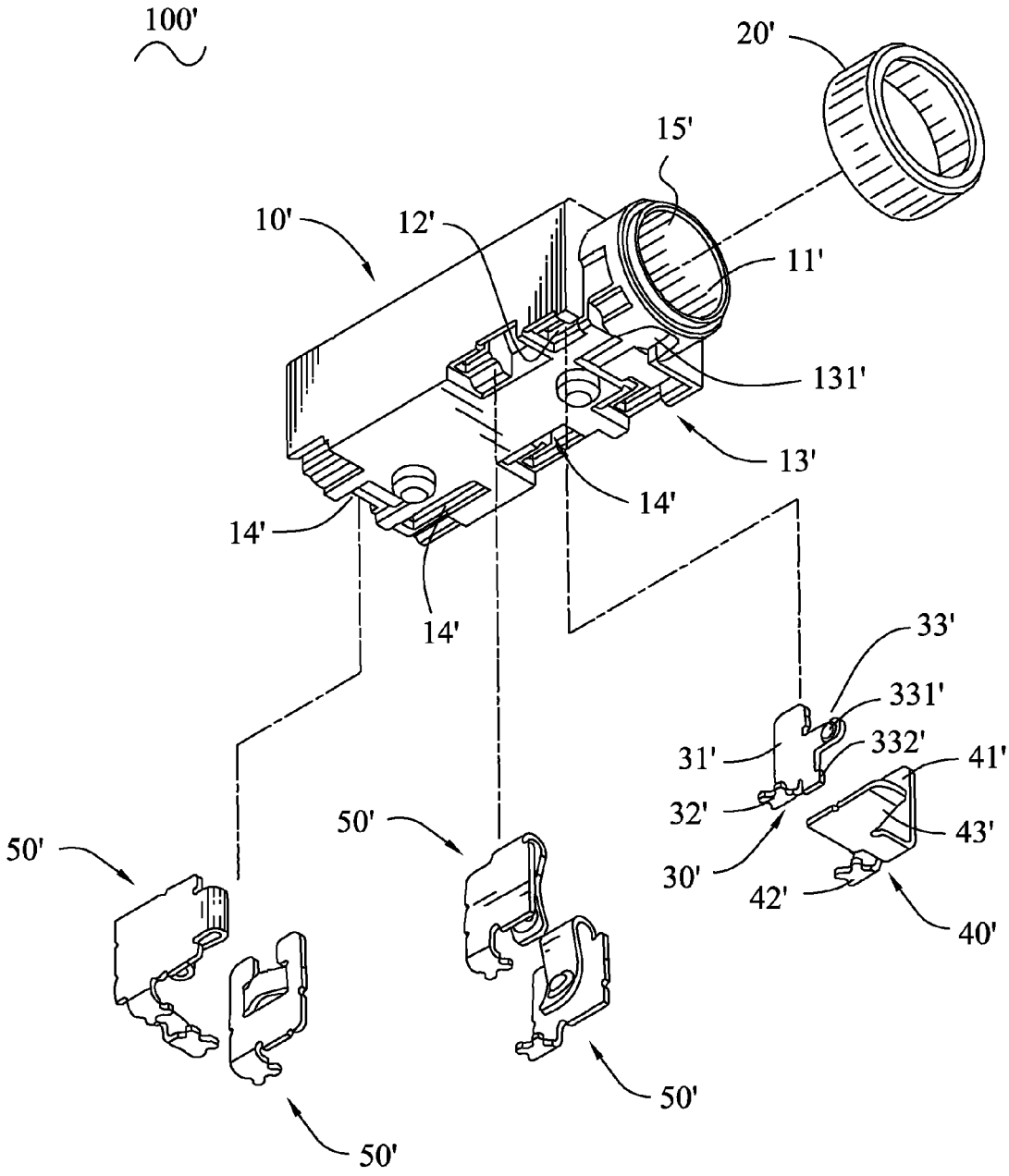
FIG. 1 (Prior Art)
FIG. 1 is an exploded, perspective view of an audio jack connector in prior art.

Reference will now be made to the drawing figures to describe the present invention in detail.

Figure 2:
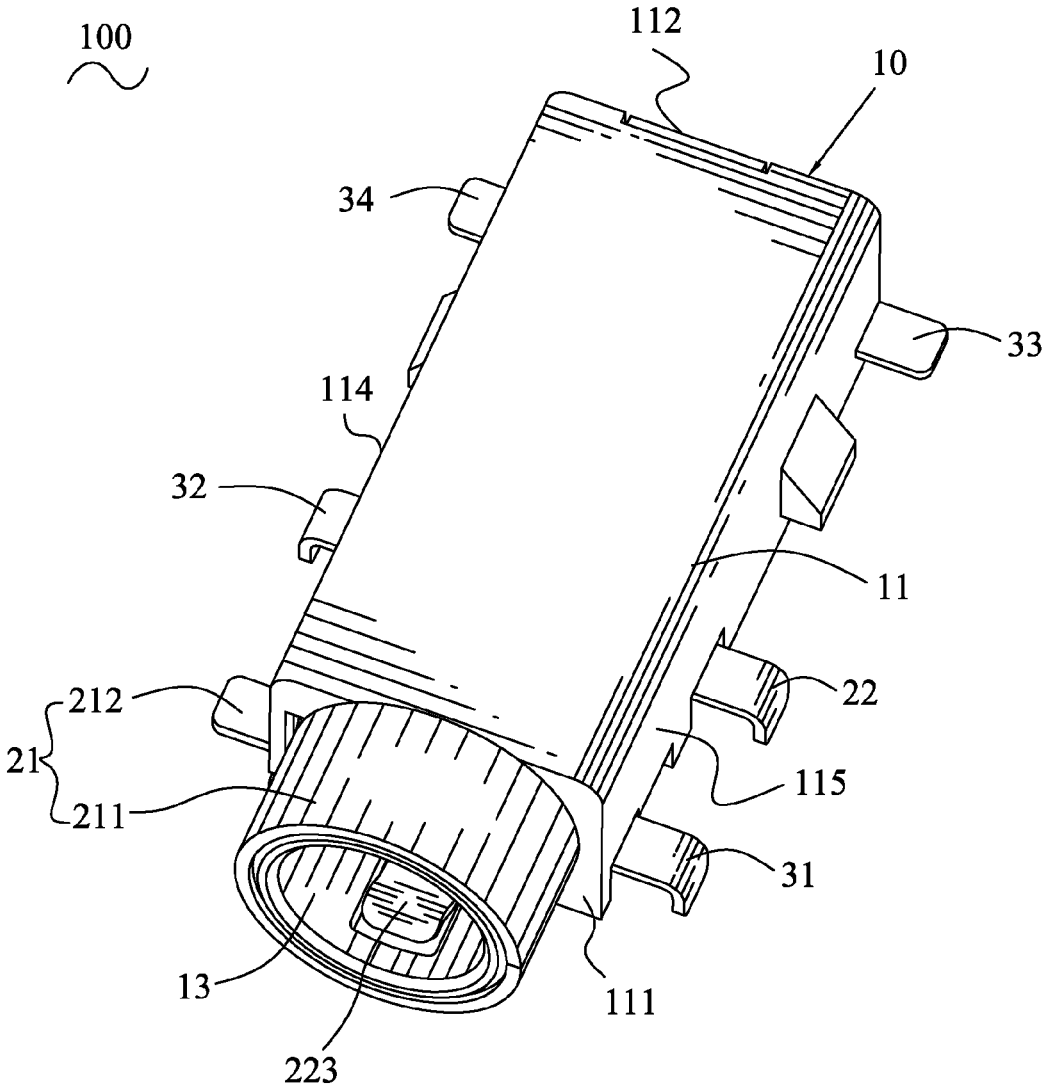
FIG. 2 is an assembled, perspective view of an audio jack connector of an embodiment in accordance with the present invention.
Figure 3:
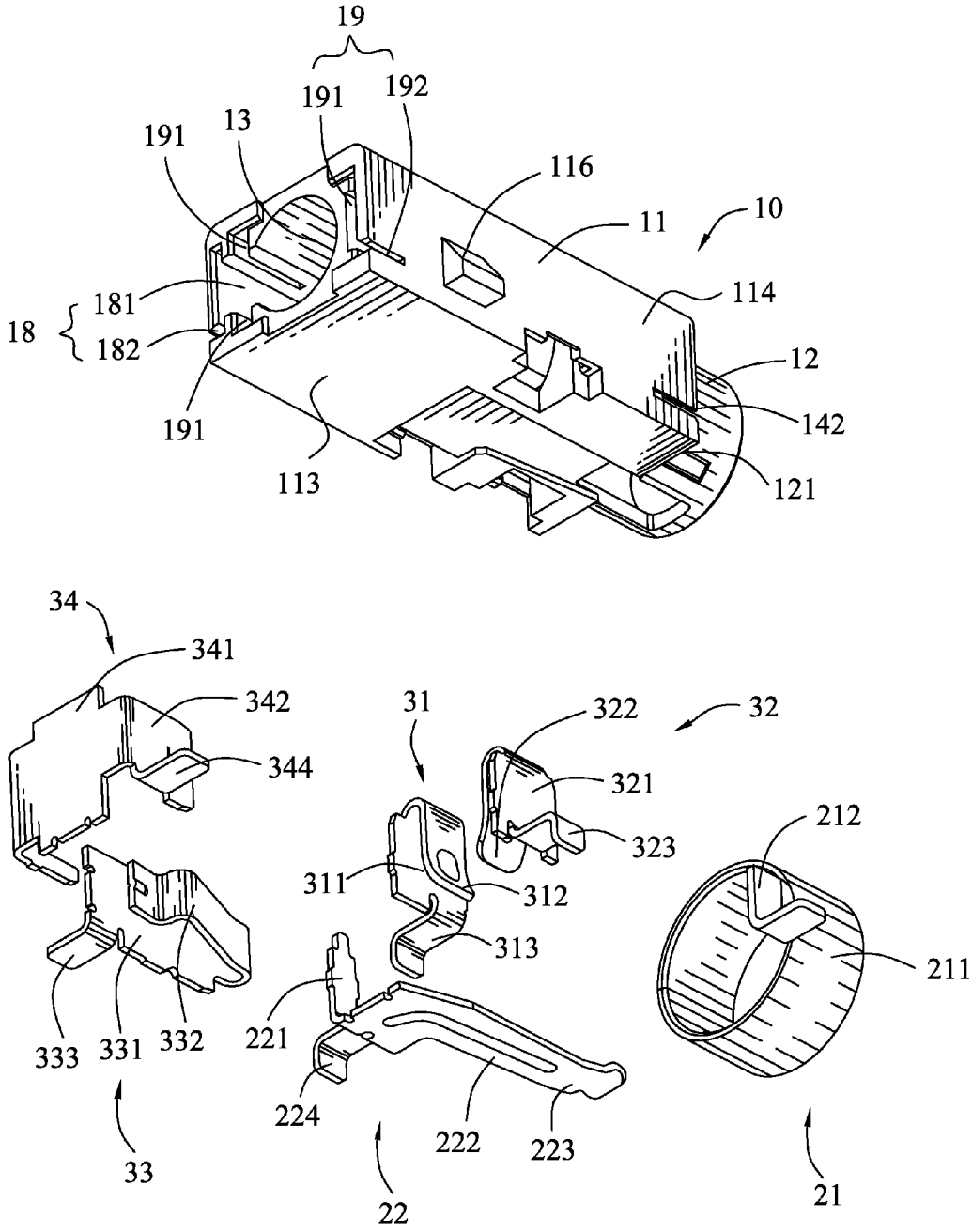
FIG. 3 is an exploded, perspective view of the audio jack connector shown in FIG. 2.

Please refer to FIGS. 2-3, an audio jack connector 100 for receiving a mating audio plug (not shown) comprises an insulating housing 10, a plurality of contacts received in the insulating housing 10, and a shielding shell 21 covering the insulating housing 10.

Figure 4:
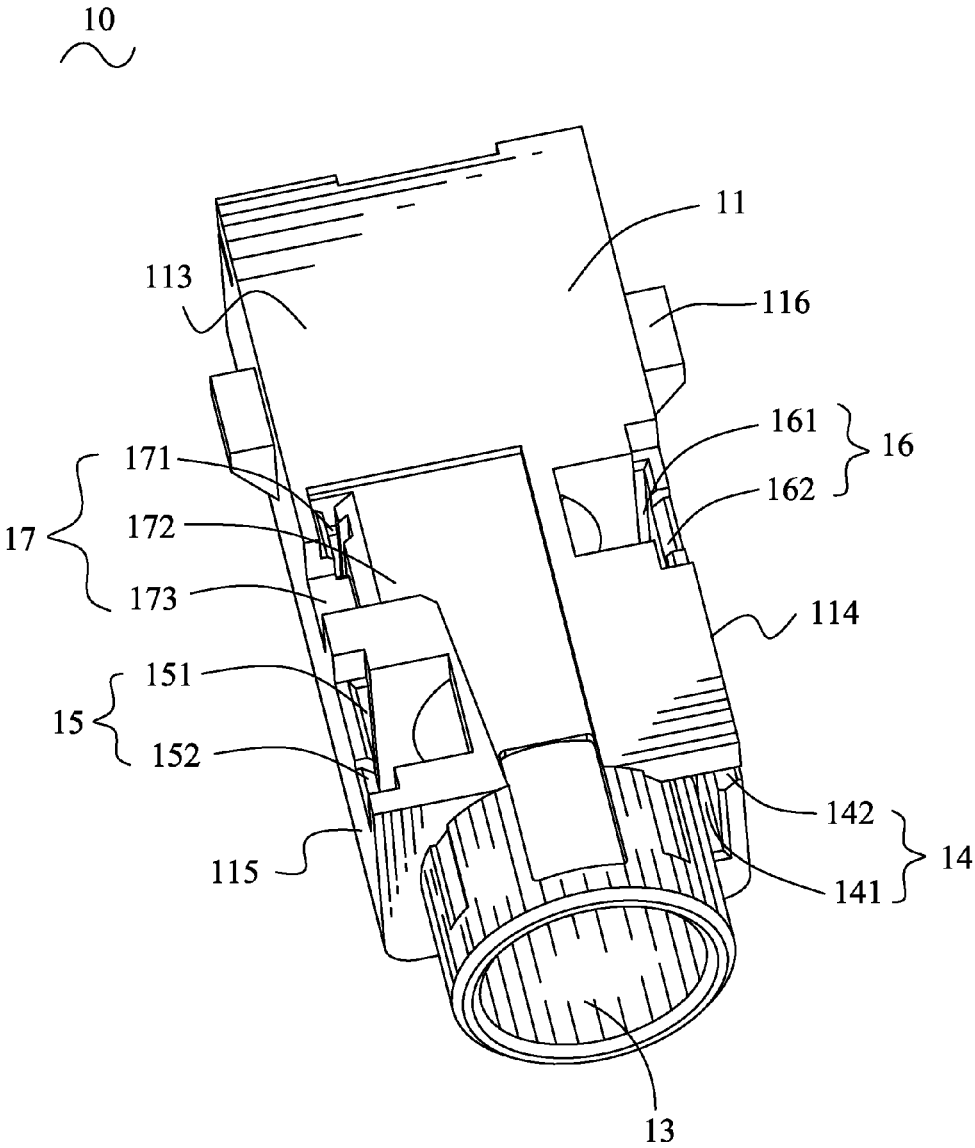
FIG. 4 is a perspective view of an insulating housing of the audio jack connector shown in FIG. 2 viewed from a bottom angle.

Referring to FIGS. 2-4, the insulating housing 10 has a substantially rectangular base 11. The base 11 defines a front end 111, a rear end 112 opposite to the front end 111, a bottom surface 113 both connecting with the front end 111 and the rear end 112, and two lateral surfaces 114, 115. The front end 111 is protruded forwards to form an insertion portion 12. A passageway 13, with a circular cross-section, is formed in a front of the insertion portion 12 and extends rearwards to pass through the whole base 11, for receiving the audio plug. The insertion portion 12 is shaped as a cylinder and formed with a plurality of positioning troughs 121 at an outer surface thereof. A holding recess 14 is formed at the front end 111, including a holding slot 141 which extends upwards and downwards and is adjacent to the insertion portion 12 and the bottom surface 113, and a through slot 142 which passes through a lower end of an outer side of the holding slot 141, exposed to the lateral surface 114.

The bottom surface 113 has a first recess 15 at a front thereof and adjacent to the lateral surface 115, a second recess 16 and a switch recess 17 which are both located at a substantially middle portion thereof. The first recess 15 has a first receiving groove 151 which communicates with the passageway 13, and a first penetrating groove 152 formed at a front end of an outer side of the first receiving groove 151 and reaching the lateral surface 115. The second recess 16 has a second receiving groove 161 which communicates with the passageway 13 and is adjacent to the lateral surface 114, and a second penetrating groove 162 formed at a front end of an outer side of the second receiving groove 161 and reaching the lateral surface 114. The switch recess 17 has a fixing slot 171 extending frontward and rearward and adjacent to the lateral surface 115, a notch 173 formed at a front end of an outer side of the fixing slot 171, exposing the lateral surface 115, and a receiving trough 172 located at a side of the fixing slot 171 opposite to the lateral surface 115. The receiving trough 172 is substantially an L shape and has a leg portion extending forwards to reach the insertion portion 12 and communicate with the passageway 13.

Please refer to FIGS. 2-3, the rear end 112 has two fourth recesses 19 at two opposite sides of the passageway 13, and a third recess 18 located at an outer side of the fourth recess 19 adjacent to the lateral surface 115. Each of the fourth recesses 19 has a fourth receiving groove 191 which extends upwards and downwards. The fourth receiving groove 191 adjacent to the lateral surface 114 has a fourth penetrating groove 192 at a lower end of an outer side thereof and reaching the lateral surface 114. The third recess 18 has a third receiving groove 181 which communicates with the fourth receiving groove 191, and a third penetrating groove 182 formed at a lower end of an outer side of the third receiving groove 181 and reaching the lateral surface 115. Each of the lateral surfaces 114, 115 has a stopping lump 116 which is adapted for pressing a top surface of a printed circuit board (PCB, not shown) to achieve position function.

Figure 5:
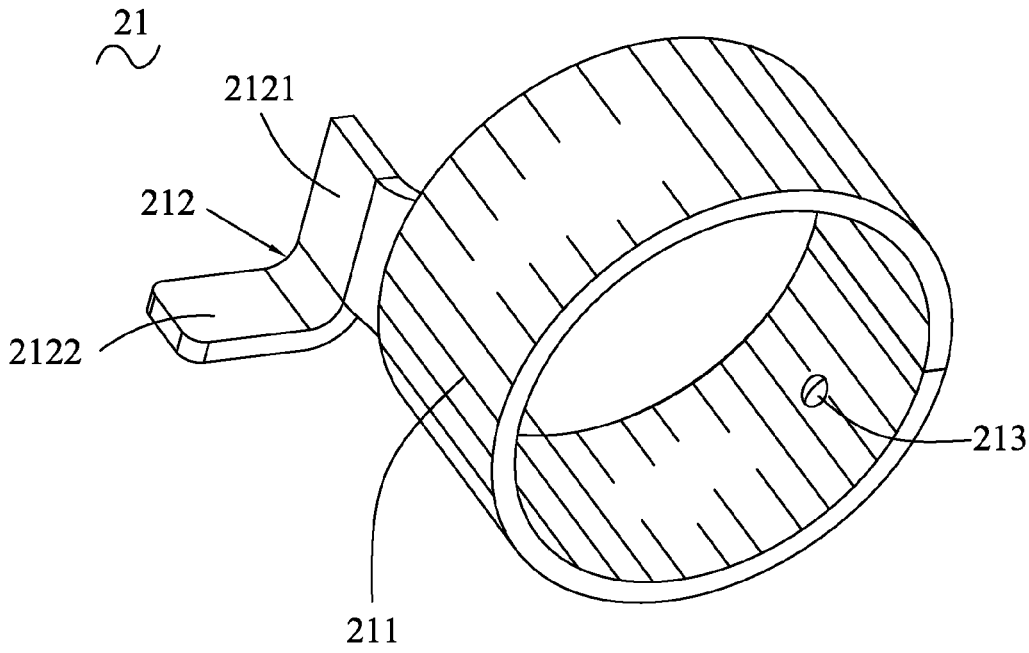
FIG. 5 is a perspective view of a shielding shell of the audio jack connector shown in FIG. 2.

With reference to FIG. 3 and FIG. 5, the shielding shell 21 has a barrel 211 surrounding a periphery of the insertion portion 12, and a grounding element 212 of substantially inverted-L shape connected with the barrel 211. The barrel 211 has a plurality of protrusions 213 at an inner surface thereof, which are inserted into the positioning troughs 121 for fixing the shielding shell 21 to the insertion portion 12. The grounding element 212 received in the holding recess 14 has a rectangular connecting slice 2121 extending rearwards from a portion of a rear edge of the barrel 211, and a grounding slice 2122 bent outwardly and perpendicularly from a lower edge of the connecting slice 2121. The connecting slice 2121 is received in the holding slot 141. The grounding slice 2122 extends though the through slot 142 and exposes outside the insulating housing 10 for being grounded to the PCB.

Please refer to FIGS. 3-4, the contacts comprises a switch contact 22, a first connecting contact 31, a second connecting contact 32, a third connecting contact 33 and a fourth connecting contact 34. The switch contact 22 received in the switch recess 17 has a substantially rectangular fixing slice 221, a connecting arm 222 and a soldering peg 224 bent toward two opposite sides of the fixing slice 221 from a lower edge of the fixing slice 221, respectively. The connecting arm 222 is an inverted-L shape and has a leg extending forwards. A free end of the connecting arm 222 is arched upwards to form a contact end 223. The soldering peg 224 is an inverted-L shape and has a leg facing downwards. In assembly, the fixing slice 221 is received in the fixing slot 171. The connecting arm 222 is received in the receiving trough 172, with the contact end 223 projecting inward the passageway 13. The soldering peg 224 passes through the notch 173 and exposes outside the insulating housing 10 for being soldered to the PCB.

The first connecting contact 31 has a first holding portion 311 of rectangular flat plane shape, a first contacting portion 312 extended from a top edge of the first holding portion 311 and folded with respect to the first holding portion 311, and a first soldering portion 313 bent opposite to the first contacting portion 312 from a bottom edge of the first holding portion 311. The first soldering portion 313 is substantially an inverted L shape and has a leg facing downwards. The first holding portion 311 is received in the first receiving groove 151, with the first contacting portion 312 projecting into the passageway 13 for electrically connecting with the inserted audio plug. The first soldering portion 313 passes through the first penetrating groove 152 and exposes outside the insulating housing 10 for being soldered to the PCB. The second connecting contact 32, which is mounted into the second recess 16, has substantially same structure as that of the first connecting contact 31, and includes a second holding portion 321 received in the second receiving groove 161, a second contacting portion 322 projecting into the passageway 13, and a second soldering portion 323 exposing outside the insulating housing 10 through the second penetrating groove 162.

Figure 6:
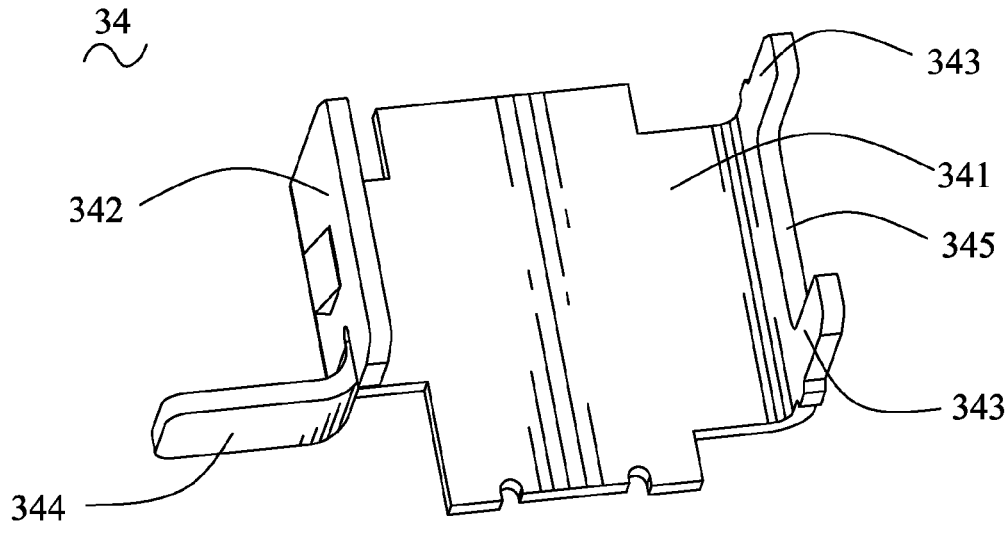
FIG. 6 is a perspective view of a fourth connecting contact of the audio jack connector shown in FIG. 2 seen from another angle.

Referring to FIGS. 3-4 and FIG. 6, the third connecting contact 33 has a third holding portion 331 of rectangular flat plane shape, a third contacting portion 332 extended from a front edge of the third holding portion 331 and folded with respect to the third holding portion 331, and a third soldering portion 333 bent opposite to the third contacting portion 332 from a rear end of a bottom edge of the third holding portion 331. The third holding portion 331 is received in the third receiving groove 181, with the third contacting portion 332 projecting into the passageway 13 for electrically connecting with the inserted audio plug. The third soldering portion 333 passes through the third penetrating groove 182 and exposes outside the insulating housing 10 for being grounded to the PCB. The fourth connecting contact 34 has a cover portion 341 of substantially oblong shape, a pair of lateral slices 342, 343 extended forwards and perpendicularly from two opposite sides of the cover portion 341. The cover portion 341 is attached to the rear end 112, sealing a rear end of the passageway 13. The lateral slices 342 are received in the fourth receiving grooves 191. The lateral slice 342, adjacent to the lateral surface 114, has a fourth soldering portion 344 which is bent outwards from a bottom edge thereof. The fourth soldering portion 344 passes through the fourth penetrating groove 192 and exposes outside the insulating housing 10 for being grounded to the PCB. The lateral slice 343, adjacent to the lateral surface 115, is formed with an opening 345 at a front thereof. In assembly, the third contacting portion 332 has a distal end passing through the opening 345 to rest against an outer side of the lateral slice 343. When the audio plug is inserted into the passageway 13, the third contacting portion 332 is pressed by the audio plug to depart from the lateral slice 343.

Please refer to FIGS. 2-3, when the audio plug is inserted into the passageway 13, the contact end 223 of the switch contact 22 is pressed to connect with the barrel 211 of the shielding shell 21. Since the grounding slice 2122 of the shielding shell 21 is grounded, the static electricity generated from the barrel 211 and the connection between the barrel 211 and the contact end 223 is released, which is effective to prevent from the interference of the static electricity.

As described above, the audio jack connector 100 is provided with the shielding shell 21. The shielding shell 21 has the barrel 211 around the insertion portion 12 and the grounding element 212 of substantially inverted-L shape connected with the barrel 211 and grounded to the PCB to release the generated static electricity. Such structure is simple and convenient to manufacture and assemble. Furthermore, the connection structure between the barrel 211 and the grounding element 212 is firm and steady, which is excellent to guarantee the grounding effect.

What is claimed is:

1. An audio jack connector for receiving a mating audio plug, comprising:

an insulating housing having a rectangular base, the base defining a front end and a bottom surface, the front end being protruded forwards to form an insertion portion, a passageway formed at a front of the insertion portion and extending into the base for receiving the audio plug, the front end having a holding slot located adjacent to the insertion portion, and a through slot which passes through a portion of an outer side of the holding slot and exposes outside the insulating housing;

a plurality of contacts received in the insulating housing; and a shielding shell having a barrel surrounding a periphery of the insertion portion, and a grounding element of substantially inverted-L shape connected with the barrel, the grounding element having a connecting slice extending rearwards from a portion of a rear edge of the barrel, for inserting into the holding slot, and a grounding slice bent substantially perpendicularly from an edge of the connecting slice, for extending outside the insulating housing through the through slot.

2. The audio jack connector as claimed in claim 1, wherein the insertion portion is shaped as a cylinder, an outer periphery of the insertion portion is formed with a plurality of positioning troughs, an inner side of the barrel has a plurality of protrusions which are inserted into the positioning troughs for fixing the shielding shell to the insertion portion.

3. The audio jack connector as claimed in claim 1, wherein the holding slot extends upwards and downwards, the through slot is located adjacent to the bottom surface, the grounding slice is bent substantially perpendicularly from a lower edge of the connecting slice and received in the through slot.

4. The audio jack connector as claimed in claim 1, wherein the bottom surface has a switch recess for receiving the contact, the switch recess has a fixing slot extending frontward and rearward, a notch formed at a front end of an outer side of the fixing slot, and a receiving trough located at a side of the fixing slot opposite to the notch, the receiving trough is substantially an L shape and has a leg portion extending forwards to reach the insertion portion and communicate with the passageway.

5. The audio jack connector as claimed in claim 4, wherein one of the contacts is defined as switch contact which has a substantially rectangular fixing slice received in the fixing slot, a connecting arm and a soldering peg extended toward two opposite sides of the fixing slice from a lower edge of the fixing slice, respectively, the connecting arm is substantially an inverted-L shape, with a leg extending forwards, and received in the receiving trough, a free end of the connecting arm is arched upwards to form a contact end projecting inward the passageway for electrically connecting with the inserted audio plug.

6. The audio jack connector as claimed in claim 5, wherein the soldering peg is an inverted-L shape and has a leg facing downwards, which passes through the notch and exposes outside the insulating housing.

7. The audio jack connector as claimed in claim 1, wherein the passageway passes through a rear end of the base.

8. The audio jack connector as claimed in claim 7, wherein the rear end has two recesses at two opposite sides of the passageway, one of the contacts defined as connecting contact has a cover portion of substantially oblong shape, and a pair of lateral slices extended perpendicularly and forwardly from two opposite sides of the cover portion, the cover portion is attached to the rear end, sealing a rear end of the passageway, the lateral slices are received in the recesses.

9. The audio jack connector as claimed in claim 8, wherein one of the recesses has a penetrating groove passing through at a lower portion of an outer side thereof, a soldering portion is bent outwards from a bottom edge of the corresponding lateral slice for exposing outside the insulating housing through the penetrating groove.

* * * * *